US009191999B2

(12) United States Patent
Anthony et al.

(10) Patent No.: US 9,191,999 B2
(45) Date of Patent: Nov. 17, 2015

(54) METHOD AND APPARATUS FOR VENTING A COOKING DEVICE

(75) Inventors: Chris Anthony, Reading (GB); Gordon Hind, Godalming (GB)

(73) Assignee: MANITOWOC FOODSERVICE COMPANIES, LLC, Manitowoc, WI (US)

( * ) Notice: Subject to any disclaimer, the term of this patent is extended or adjusted under 35 U.S.C. 154(b) by 170 days.

(21) Appl. No.: 12/872,981

(22) Filed: Aug. 31, 2010

(65) Prior Publication Data

US 2011/0049136 A1 Mar. 3, 2011

Related U.S. Application Data

(60) Provisional application No. 61/239,007, filed on Sep. 1, 2009.

(51) Int. Cl.
*H05B 6/64* (2006.01)
*H05B 6/80* (2006.01)
*F24C 15/32* (2006.01)

(52) U.S. Cl.
CPC ..... *H05B 6/6476* (2013.01)

(58) Field of Classification Search
CPC ..... H05B 6/6476; F24C 15/006
USPC ..... 219/725, 757, 681, 682, 400, 388; 126/21 A, 20, 273.5; 426/523; 96/4
See application file for complete search history.

(56) References Cited

U.S. PATENT DOCUMENTS 3,384,067 A * 5/1968 Rawald et al. ..... 126/21 A
3,654,417 A 4/1972 Javes et al. ..... 219/10.55
3,783,219 A * 1/1974 Tateda ..... 219/757
3,818,171 A 6/1974 Miller et al. ..... 219/10.55
3,924,601 A 12/1975 Nuss ..... 126/21 R
4,091,252 A 5/1978 Koinuma ..... 219/10.55 R
4,115,678 A * 9/1978 Tachikawa et al. ..... 219/710
4,162,381 A 7/1979 Buck ..... 219/10.55 B
4,180,049 A * 12/1979 Carr et al. ..... 126/21 A
4,331,124 A * 5/1982 Seidel et al. ..... 126/21 A
4,481,395 A 11/1984 Smith et al. ..... 219/10.55 E
4,508,947 A 4/1985 Eke ..... 219/10.55 B
4,527,542 A 7/1985 Bales et al. ..... 126/299 D
4,591,683 A 5/1986 Eke ..... 219/10.55 B
4,598,689 A 7/1986 Eke ..... 126/21 A
4,692,580 A 9/1987 Bell ..... 219/10.55 M
4,743,728 A * 5/1988 Nagafusa et al. ..... 219/757
4,786,774 A 11/1988 Kaminaka ..... 219/10.55 R
4,801,773 A 1/1989 Hanlon ..... 219/10.55 E
4,839,502 A 6/1989 Swanson et al. ..... 219/401
4,865,010 A 9/1989 Kett ..... 126/21 R
4,868,358 A 9/1989 Yamasaki ..... 219/10.55 D (Continued)

OTHER PUBLICATIONS

International Search Report and Written Opinion dated Oct. 21, 2010 for corresponding International Patent Application No. PCT/US2010/047363.

(Continued)

*Primary Examiner* — Quang Van

(74) *Attorney, Agent, or Firm* — Ohlandt, Greeley, Ruggiero & Perle, L.L.P.

(57) ABSTRACT

A cooking device includes an airflow system that generates airflow within a duct and a cooking chamber that is configured to vent heated air and/or steam within the cooking chamber to the duct. The heated air and/or steam vented to the duct is accelerated by the airflow.

11 Claims, 4 Drawing Sheets

(56) References Cited

U.S. PATENT DOCUMENTS

| | | | | |
|---|---|---|---|---|
| 4,874,620 | A | 10/1989 | Mendenhall et al. | 426/113 |
| 4,962,000 | A | 10/1990 | Emslander et al. | 428/461 |
| 5,012,061 | A | 4/1991 | Lesser | 219/10.55 E |
| 5,075,526 | A | 12/1991 | Sklenak et al. | 219/10.55 E |
| 5,126,520 | A | 6/1992 | Nottingham et al. | 219/10.55 E |
| 5,241,150 | A | 8/1993 | Garvey et al. | 219/10.55 E |
| 5,310,981 | A | 5/1994 | Sarnoff et al. | 219/731 |
| 5,387,781 | A | 2/1995 | Berkoff | 219/735 |
| 5,512,312 | A | 4/1996 | Forney et al. | 426/523 |
| 5,558,798 | A | 9/1996 | Tsai | 219/731 |
| 5,575,943 | A | 11/1996 | Lee | 219/710 |
| 5,780,824 | A | 7/1998 | Matos | 219/727 |
| 5,798,505 | A | 8/1998 | Lee | 219/681 |
| 5,814,793 | A | 9/1998 | Yu | 219/757 |
| 5,847,377 | A | 12/1998 | Yang et al. | 219/757 |
| 5,886,330 | A | 3/1999 | Kang et al. | 219/757 |
| 5,918,589 | A | 7/1999 | Valle et al. | 126/193 |
| 5,942,142 | A * | 8/1999 | Forney et al. | 219/388 |
| 5,945,021 | A | 8/1999 | Chung | 219/682 |
| 5,951,907 | A | 9/1999 | Kang | 219/757 |
| 6,005,235 | A | 12/1999 | Shin | 219/757 |
| 6,017,147 | A | 1/2000 | Gibson, Jr. | 374/32 |
| 6,054,698 | A | 4/2000 | Mast | 219/730 |
| 6,093,920 | A | 7/2000 | Beckwith | 219/734 |
| 6,100,514 | A | 8/2000 | Davis | 219/735 |
| 6,104,014 | A | 8/2000 | Chung | 219/682 |
| 6,127,666 | A | 10/2000 | Sohn | 219/757 |
| 6,137,097 | A | 10/2000 | Smith et al. | 219/725 |
| 6,187,354 | B1 | 2/2001 | Hopkins | 426/234 |
| 6,218,653 | B1 | 4/2001 | Kang | 219/757 |
| 6,229,131 | B1 | 5/2001 | Koochaki | 219/731 |
| 6,250,296 | B1 | 6/2001 | Norris et al. | 126/21 A |
| 6,278,099 | B1 | 8/2001 | Kang | 219/757 |
| 6,303,913 | B1 | 10/2001 | Bono et al. | 219/730 |
| 6,303,914 | B1 | 10/2001 | Bono et al. | 219/730 |
| 6,309,684 | B2 | 10/2001 | Hopkins, Sr. | 426/234 |
| 6,342,693 | B1 | 1/2002 | Smith et al. | 219/756 |
| 6,364,761 | B1 | 4/2002 | Steinbrecher | 454/184 |
| 6,414,288 | B1 | 7/2002 | Bono et al. | 219/730 |
| 6,420,690 | B1 | 7/2002 | Kim | 219/757 |
| 6,433,323 | B2 | 8/2002 | Kim | 219/757 |
| 6,433,324 | B1 | 8/2002 | Kim | 219/757 |
| 6,455,084 | B2 | 9/2002 | Johns | 426/107 |
| 6,469,287 | B1 | 10/2002 | Kim | 219/751 |
| 6,559,431 | B2 | 5/2003 | Hopkins | 219/735 |
| 6,621,057 | B2 | 9/2003 | Kim | 219/757 |
| 6,649,892 | B2 | 11/2003 | Linn et al. | 217/761 |
| 6,680,467 | B1 | 1/2004 | Whipple, Jr. | 219/747 |
| 6,686,576 | B1 | 2/2004 | Yang | 219/757 |
| 6,717,122 | B2 | 4/2004 | Roh | 219/756 |
| 6,761,159 | B1 | 7/2004 | Barnes et al. | 126/21 R |
| 6,768,090 | B2 | 7/2004 | Kang | 219/757 |
| 6,797,930 | B2 | 9/2004 | Kim | 219/757 |
| 6,818,874 | B2 | 11/2004 | Jeong | 219/757 |
| 6,825,452 | B2 | 11/2004 | Oh | 219/682 |
| 6,838,649 | B2 | 1/2005 | Lee | 219/757 |
| 6,844,534 | B2 | 1/2005 | Haamer | 219/700 |
| 6,847,022 | B2 | 1/2005 | Hopkins, Sr. | 219/735 |
| 6,861,631 | B2 | 3/2005 | Hahm et al. | 219/682 |
| 6,878,910 | B2 | 4/2005 | Kim et al. | 219/682 |
| 6,894,257 | B2 | 5/2005 | Kim | 219/682 |
| 6,906,298 | B2 | 6/2005 | Han et al. | 219/702 |
| 6,909,076 | B2 | 6/2005 | Lee | 219/702 |
| 6,909,079 | B2 | 6/2005 | Lee et al. | 219/757 |
| 6,953,920 | B2 | 10/2005 | Jeon | 219/682 |
| 6,987,246 | B2 | 1/2006 | Hansen et al. | 219/401 |
| 7,002,125 | B2 | 2/2006 | Lee | 219/757 |
| 7,019,271 | B2 | 3/2006 | Wnek et al. | 219/730 |
| 7,019,272 | B2 | 3/2006 | Braunisch et al. | 219/757 |
| 7,034,268 | B2 | 4/2006 | Hopkins, Sr. | 219/735 |
| 7,049,568 | B2 | 5/2006 | Jeong | 219/757 |
| 7,064,305 | B2 | 6/2006 | Lee | 219/702 |
| 7,105,788 | B2 | 9/2006 | Hopkins | 219/725 |
| 7,141,771 | B2 | 11/2006 | Hopkins, Sr. | 219/728 |
| 7,193,195 | B2 | 3/2007 | Lundstrom et al. | 219/757 |
| 7,244,915 | B2 | 7/2007 | Wright | 219/734 |
| 7,348,527 | B2 | 3/2008 | Braunisch et al. | 219/757 |
| 7,375,310 | B2 | 5/2008 | Oh et al. | 219/757 |
| 2003/0061938 | A1 * | 4/2003 | Kunstadt et al. | 96/4 |
| 2006/0191925 | A1 | 8/2006 | Iwamoto | 219/757 |

OTHER PUBLICATIONS

International Preliminary Report on Patentability Mailed Apr. 19, 2012 in the Corresponding PCT/US10/47363.

* cited by examiner

METHOD AND APPARATUS FOR VENTING A COOKING DEVICE

CROSS-REFERENCE TO RELATED APPLICATIONS

This application claims the benefit of U.S. Provisional Application No. 61/239,007, filed Sep. 1, 2009. U.S. Provisional Application No. 61/239,007, filed Sep. 1, 2009 is hereby incorporated by reference in its entirety.

BACKGROUND OF THE INVENTION

1. Field of the Invention

The present disclosure relates generally to venting a cooking device. More particularly, the present disclosure relates to venting a cooking chamber of a cooking device into an exhaust of air.

2. Description of Related Art

Most food products, when cooked in a cooking chamber of an oven, produce an amount of steam. This expanding gas or steam needs to escape from the cooking chamber via either an access port, or a door to the cooking chamber. Steam vents generally are between the cooking chamber and ambient environment to allow controlled dissipation of pressure by exhausting exhaust gases including the expanding gas or steam through the steam vent to the ambient environment. The exiting exhaust gases can reach very high temperatures causing both the oven and ambient environment to be adversely affected by the heat. Further, since the exhaust gases can become polluted with airborne contaminates from the food product, the contaminates, e.g., grease, can condense on exit from the vent and drip/stain/contaminate surrounding environments.

Accordingly, it has been determined by the present disclosure, there is a need for a device to reduce a temperature of exhaust gases when exiting a cooking device. There is a further need to decrease a concentration of particles within the exhaust gases when exiting a cooking device.

BRIEF SUMMARY OF THE INVENTION

A cooking device is provided that includes an airflow system that generates airflow within a duct and a cooking chamber that is configured to vent heated air and/or steam within the cooking chamber to the duct. The heated air and/or steam vented to the duct is accelerated by the airflow.

The above-described and other advantages and features of the present disclosure will be appreciated and understood by those skilled in the art from the following detailed description, drawings, and appended claims.

DETAILED DESCRIPTION OF THE INVENTION

Figure 1:
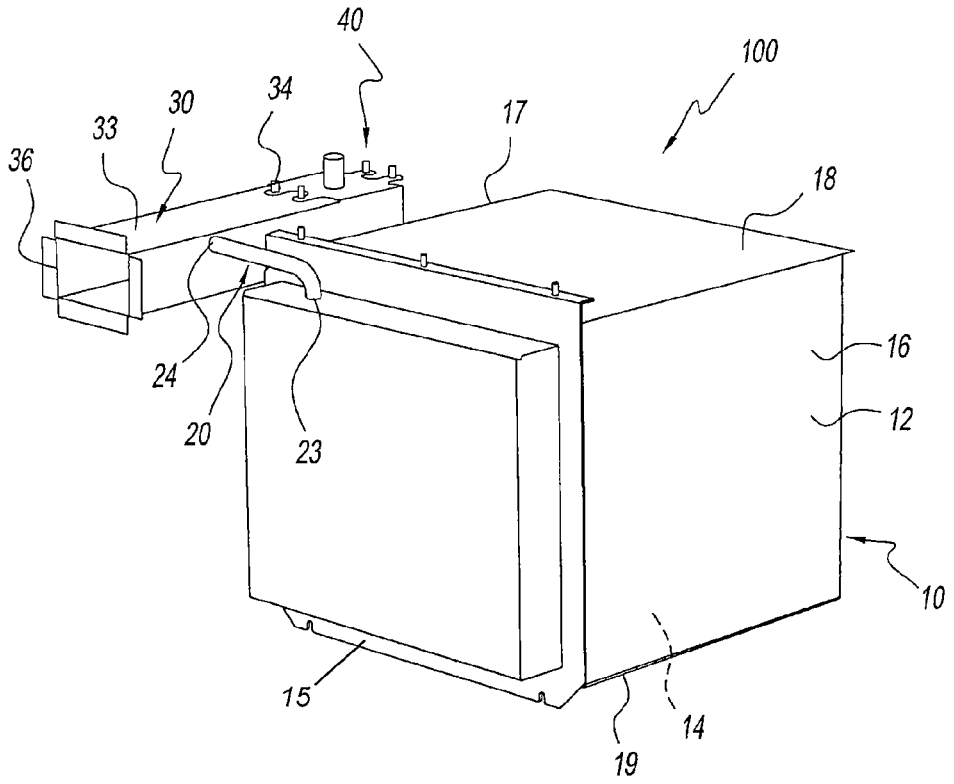
FIG. 1 is a partial rear perspective view of a cooking device according to the present disclosure.

Referring to the drawings and in particular to FIG. 1, an exemplary embodiment of a cooking device according to the present disclosure is generally referred to by reference numeral 100. Cooking device 100 may be any device that heats food, such as, for example, an oven.

Cooking device 100 has a cooking chamber 10. Cooking chamber 10 has an enclosure 12 surrounding a cavity 14. Enclosure 12 includes a rear wall 15, side walls 16 and 17, a top wall 18, and a bottom wall 19. Enclosure 12 has an open portion 11, as shown in FIG. 2.

Cooking device has a duct 30. Duct 30 is a conduit 33 having an inlet 34 and an outlet 36. Duct 30 may be connected to a magnetron 40 of a microwave system.

Cavity 14 is in fluid communication with duct 30. Cavity 14 is in fluid communication with duct through pipe 20. Pipe 20 has an inlet 23 and an outlet 24.

Figure 2:
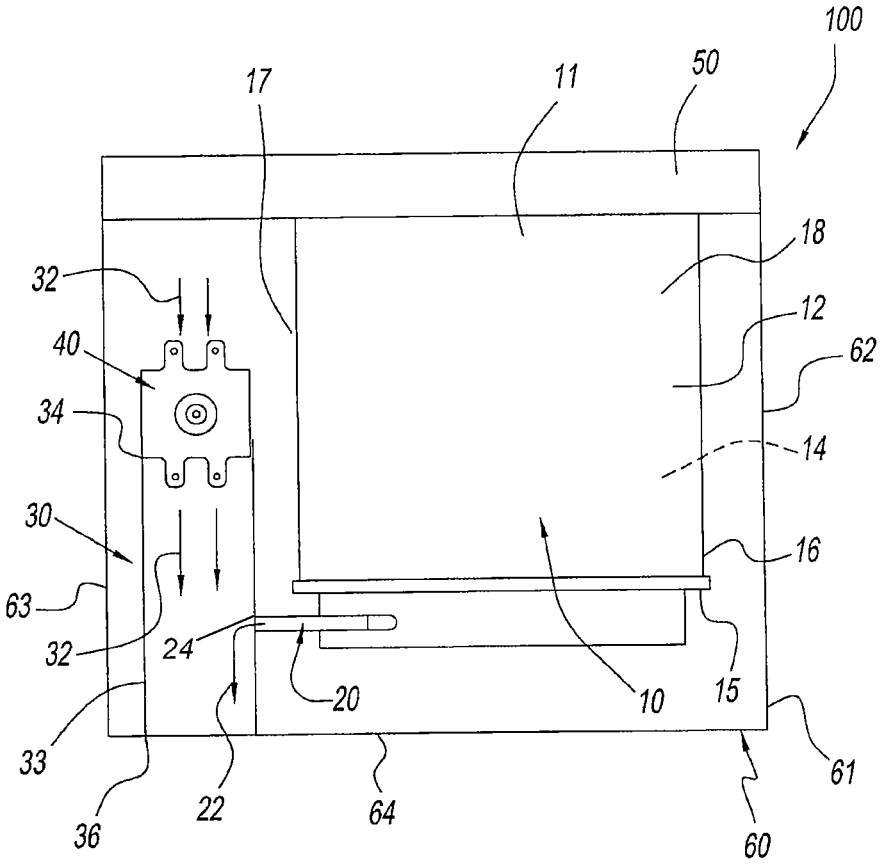
FIG. 2 is a partial top, cross-sectional view of the exemplary embodiment of the cooking device of FIG. 1.

Referring now to FIG. 2, duct 30 is in fluid communication with an airflow system that generates an airflow 32. Airflow 32 enters duct 30 through inlet 34 and exits cooking device through outlet 36.

Heated air and/or steam is produced within cavity 14 that increases pressure within cavity 14. In order to relieve the pressure within cavity 14, a portion of the heated air and/or steam is vented to duct 30, as shown by arrow 22. The heated air and/or steam is accelerated by airflow 32 as the heated air and/or steam flows into duct 30.

The portion of the heated air and/or steam that is vented to duct 30 is vented through pipe 20 to duct 30, as shown by arrow 22. The heated air and/or steam is accelerated by airflow 32 as the heated air and/or steam flows through pipe 20 into duct 30. Pipe 20 is connected to an upper rear portion of cooking chamber 10. However, pipe 20 may be connected to cooking chamber 10 at other locations. Pipe 20 has a shape and size that can vary with dimensions of cooking device 100. Duct 30 may have a size to give optimum airflow for cooling cooking device components, for example, magnetron 40, and, therefore, flow of air over pipe 20. For example, a size of pipe 20 is substantially smaller than a size of duct 30, such as, 1:1000.

Cooking device 100 has a housing 60, as shown in FIG. 2. Housing 60 surrounds cooking chamber 10 and duct 30. Housing 60 has an outer wall 61 that has a first sidewall 62, a second sidewall 63, a top wall 65, a bottom wall 66, and a rear wall 64. Duct 30 is positioned so that airflow out of outlet 36 passes through an opening in rear wall 64. Housing 60 is connected to a door 50. Open portion 11 is covered by door 50 in a closed position, as shown in FIG. 2. Door 50 can be selectively rotated away from cooking device 100 to uncover open portion 11 to provide access to cavity 14.

Figure 3:
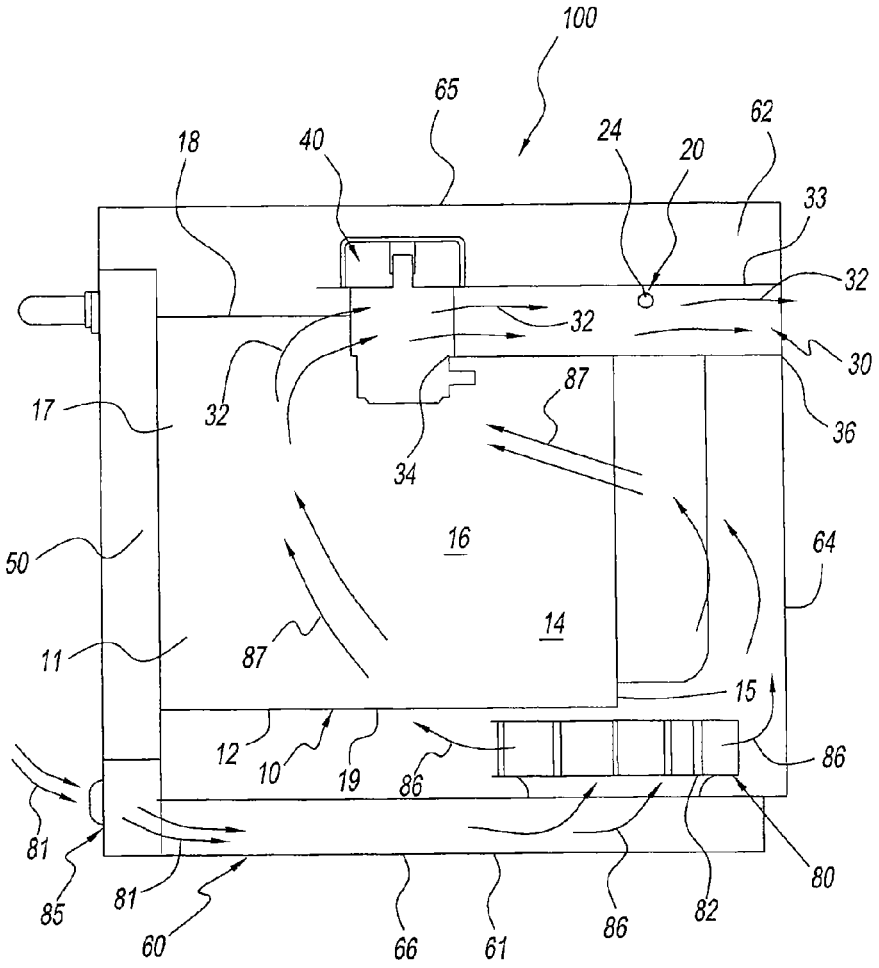
FIG. 3 is a partial side, cross-sectional view of the exemplary embodiment of the cooking device of FIG. 1.

As shown in FIG. 3, airflow 32 is generated by an airflow system 80. A fan 82 draws cool, filtered air from the ambient environment outside of cooking device 100 through an opening 85 in housing 60, as shown by arrows 81. The air flows between housing 60 and cooking chamber 10 through fan 82, as shown by arrows 86, the air flows from fan 82 up to magnetron 40, as shown by arrows 87. Fan 82 creates an internal air pressure within housing 60 which forms airflow 32 that flows through duct 30 to the ambient environment outside of cooking device 100.

The air from the ambient environment that is drawn into cooking device 100 is at a cooler temperature than air within the cooking device 100 during operation, and may pass over magnetron 40 to cool magnetron 40 and/or other electrical components of cooking device 100 to cool the electrical components. Air that forms airflow 32 may cool other components of cooking device, such as, for example, other electrical components that may include a transformer, motor of a fan, and other components that heat may have a detrimental effect thereon. Advantageously, airflow being generated by cooling system 80 that generates airflow 32 and also cools magnetron 40 and/or other components of cooking device 100, eliminates a need for separate sources of airflow, one for each of airflow 32 and cooling air for magnetron 40 and/or other components of cooking device 100. However, airflow 32 that accelerates the heat and/or steam being vented from cooking chamber 10 to duct 30 may be generated by a source that is separate from airflow being generated to cool magnetron 40 and/or other components of cooking device 100, such as, for example, a fan that does not generate airflow in fluid and/or thermal communication with magnetron 40 and/or other components of cooking device 100. This airflow may be generated from a different source than the cooling fan used to cool the magnetron and would be in the form of an additional cooling fan.

Figure 4:
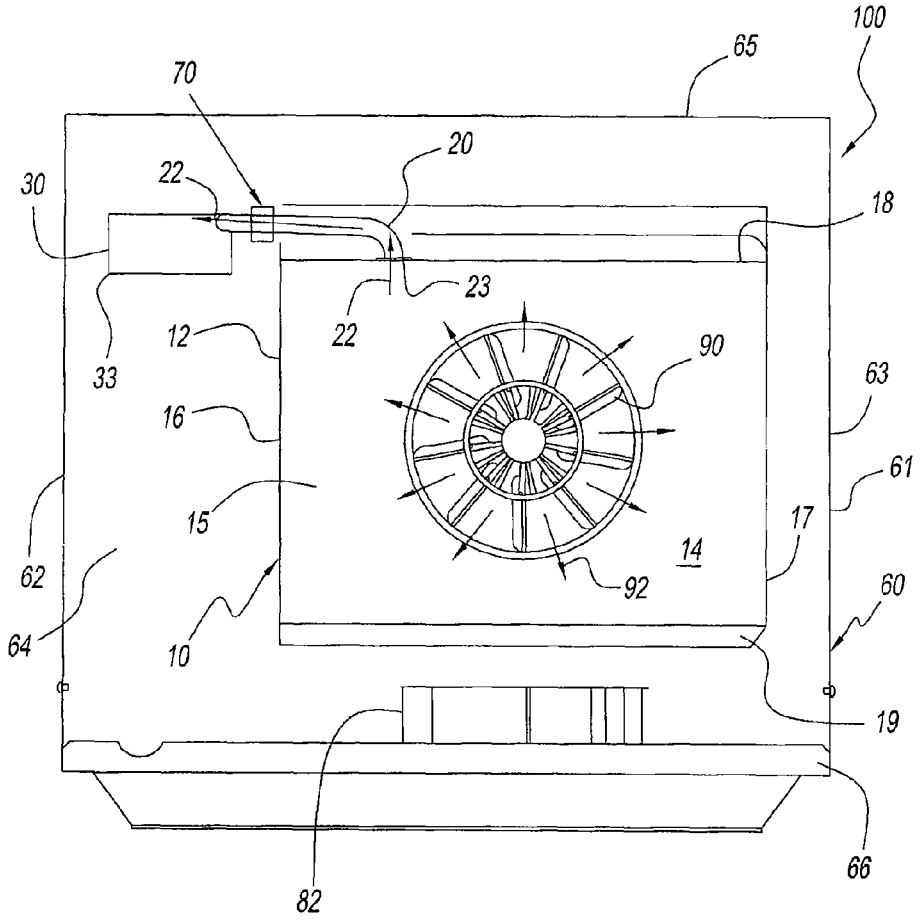
FIG. 4 is a partial front, cross-sectional view of the exemplary embodiment of the cooking device of FIG. 1.

As shown in FIG. 4, a fan 90 may be in fluid communication with cavity 14. Fan 90 rotates to draw air from within housing 60 into cavity 14, as shown by arrows 92. Fan 90 may create an internal air pressure within cavity 14 which directs the heated air and/or steam to be vented, as shown by arrows 22, into duct 30. Alternatively, as the food is being heated, generally, heated air and/or steam is produced that increases pressure within cavity 14 that is vented, as shown by arrows 22, into duct 30. In addition, fan 90 may pass air over a heating element (not shown) to heat food within cavity 14 producing heated air and/or steam that increases pressure within cavity 14. The increased pressure directs the heated air and/or steam to be vented, as shown by arrows 22, into duct 30.

The food may be heated by impingement, convection, microwave, radiant heat, or other heating device in fluid and/or thermal communication with cavity 14. As shown in FIGS. 2 and 3, the food placed within cavity 14 may be heated by a microwave device that includes magnetron 40. The microwave device communicates microwaves to cavity 14. The microwaves within cavity 14 heat the food.

In operation, the food (not shown) is placed within cavity 14 to be heated. The food may be heated by impingement, convection, microwave, radiant heat, or other heating device in fluid and/or thermal communication with cavity 14. For example, the food is heated by the microwave device having magnetron 40 or fan 90 that passes air over a heating element heating airflow into cavity 14. As the food is being heated, generally, heated air and/or steam is produced that increases pressure within cavity 14, as well as, increased pressure generated by fan 90. In order to relieve the pressure within cavity 14, a portion of the heated air and/or steam is vented through pipe 20 to duct 30, as shown by arrow 22. The heated air and/or steam may be vented through pipe 20 directly to duct 30. Alternatively, as shown in FIG. 4, cavity 14 may be in fluid communication with duct 30 through a valve 70 to vent heated air and/or steam within cavity 14 when a predetermined pressure is exceeded to vent heated air and/or steam into duct 30. The air and/or steam within the cavity 14 can be vented through a valve 70 when a positive pressure above ambient is reached. Fan 82 draws cool, filtered air into housing 60, as shown by arrows 81, between housing 60 and cooking chamber 10 past components of cooking device 100, as shown by arrows 86 and 87, such as, for example, electrical components, reducing a temperature thereof. Fan 82 creates an internal air pressure within housing 60 which forms airflow 32 within duct 30. Airflow 32 accelerates the heated air and/or steam that is vented through to duct 30 from cavity 14 and forms exhaust gases or a combined airflow of the heated air and/or steam that is vented to duct 30 and air of airflow 32. The combined airflow is exhausted through outlet 34 directly outside of cooking device 100 into the ambient environment. For example, the heat/steam vented from the cooking chamber can be accelerated to a velocity in the range of about 1 meters/second up to about 10 meters/second.

It has been found by the present disclosure that acceleration of the heated air and/or steam from cavity 14 by airflow 32 in duct 30 lowers a temperature and increases a velocity of the heated air and/or steam in comparison to heated air and/or steam that is vented directly into the ambient environment from cavity 14 that would be at a lower velocity and higher temperature. Advantageously, an effect on the ambient environment that the heated air and/or steam from cavity 14 that combines with airflow 32 is exhausted into is reduced over exhausting the heated air and/or steam without combining it with airflow 32. For example, the heat/steam vented from the cooking chamber may be reduced in temperature within the range of about 200° Celsius/400° Fahrenheit by airflow 32 in duct 30.

It has also been found by the present disclosure that that the acceleration of the heated air and/or steam from cavity 14 in duct 30 accelerates airborne particles within the heated air and/or steam and reduces a concentration of the airborne particles lower than heated air and/or steam vented directly out of cavity 14 without combining with airflow 32. Advantageously, the lower concentration of the airborne particles within the combined airflow of the heated air and/or steam and airflow 32 reduces a likelihood of contamination of the ambient environment surrounding cooking device 100, such as, condensing of the airborne particles to drip/stain/contaminate the oven or ambient environment, over airborne particles exhausted within the heated air and/or steam that is not combined with airflow 32. The amount the concentration of the airborne particulate may be reduced to may be up to 13:1 by airflow 32 within duct 30.

It should also be noted that the terms "first", "second", "third", "upper", "lower", "above", "below", and the like may be used herein to modify various elements. These modifiers do not imply a spatial, sequential, or hierarchical order to the modified elements unless specifically stated.

While the present disclosure has been described with reference to one or more exemplary embodiments, it will be understood by those skilled in the art that various changes may be made and equivalents may be substituted for elements thereof without departing from the scope of the present disclosure. In addition, many modifications may be made to adapt a particular situation or material to the teachings of the disclosure without departing from the scope thereof. Therefore, it is intended that the present disclosure not be limited to the particular embodiment(s) disclosed as the best mode contemplated, but that the disclosure will include all embodiments falling within the scope of the appended claims.

What is claimed is:

1. A cooking device comprising:

a cooking chamber that is heated to cook food producing an exhaust gas in an interior volume of said cooking chamber, said exhaust gas being selected from the group consisting of heated air, airborne particles, steam, and combinations thereof;

a housing surrounding said cooking chamber, said housing and said cooking chamber having a magnetron disposed therebetween;

a duct having a wall forming a first end opposite a second end and said wall being disposed between said cooking chamber and said housing, said duct being connected to said magnetron on said first end and forming an outlet through said housing at said second end of said duct;

a first fan that generates a first airflow between said housing and said cooking chamber to cool said magnetron and that thereafter flows into said duct, wherein said first fan draws ambient air into the cooking device, and wherein said first airflow is outside of said cooking chamber, thereby avoiding the cooling of said food disposed in said cooking chamber, wherein said cooking chamber vents said exhaust gas to said duct by at least one of an apparatus selected from the group consisting of: an apparatus that heats said food to increase a pressure in said cooking chamber, and a second fan generating a second airflow which passes over a heating element into said cooking chamber, and wherein said exhaust gas that is vented to said duct is accelerated in said duct to a velocity in a range of about 1 meter/second up to about 10 meters/second by said first airflow in said duct and exhausted through said outlet out of said second end of said duct directly to an ambient environment outside of the cooking device.

2. The cooking device of claim 1, wherein said first airflow accelerates said exhaust gas reducing a temperature of said exhaust gas.

3. The cooking device of claim 1, wherein said first airflow accelerates said airborne particles lowering a concentration of said airborne particles.

4. The cooking device of claim 1, wherein said magnetron communicates microwaves to said cooking chamber.

5. The cooking device of claim 1, wherein said cooking chamber has a vent valve that vents said exhaust gas from said cooking chamber to said duct when a predetermined pressure is exceeded within said cooking chamber.

6. The cooking device of claim 1, wherein said cooking chamber is an enclosure having said interior volume.

7. The cooking device of claim 6, wherein said duct has said sidewall enclosing a duct volume.

8. The cooking device of claim 7, wherein said interior volume is connected to said duct volume by a pipe.

9. The cooking device of claim 1, wherein said first airflow combines with said exhaust gas and is directly exhausted outside of the cooking device.

10. The cooking device of claim 1, wherein said airborne particles in said duct are reduced to 13:1 by airflow within said duct.

11. A cooking device comprising:

a cooking chamber that is heated to cook food producing an exhaust gas in an interior volume of said cooking chamber, said exhaust gas being selected from the group consisting of heated air, airborne particles, steam, and combinations thereof;

a housing surrounding said cooking chamber;

a magnetron between said housing and said cooking chamber;

a duct having a wall forming an inlet at a first end and an outlet at a second end and said wall between said housing and said cooking chamber, said magnetron being connected to said inlet, and said outlet being through said housing at said second end opposite said first end;

a pipe that connects said interior volume to said duct, said pipe being smaller than said duct;

a first fan that generates a first airflow that contacts said magnetron and that thereafter passes through said duct, wherein said first airflow draws ambient air into the cooking device, and wherein said first airflow is outside of said cooking chamber, thereby avoiding the cooling of said food disposed in said cooking chamber, wherein said cooking chamber vents said exhaust gas through said pipe into said duct, and wherein said exhaust gas that is vented is accelerated in said duct by said first airflow to a velocity in a range of about 1 meter/second up to about 10 meters/second, and said exhaust gas being exhausted through said outlet out of said second end of said duct directly to an ambient environment outside of the cooking device, wherein said cooking chamber vents said exhaust gas to said duct by an apparatus selected from the group consisting of: an apparatus that heats said food to increase a pressure in said cooking chamber, and a second fan generating a second airflow which passes over a heating element into said cooking chamber.

* * * * *